United States Patent [19]

Hansel et al.

[11] Patent Number: 4,815,276

[45] Date of Patent: Mar. 28, 1989

[54] BORESCOPE PLUG

[75] Inventors: Harold R. Hansel, Mason; Vincent M. Drerup, Cincinnati, both of Ohio

[73] Assignee: The United States of America as represented by the Secretary of the Air Force, Washington, D.C.

[21] Appl. No.: 95,000

[22] Filed: Sep. 10, 1987

[51] Int. Cl.[4] ..... F01D 25/00

[52] U.S. Cl. ..... 60/39.33; 415/118

[58] Field of Search ..... 60/39.33, 39.75, 226.1; 415/118, 201; 356/241

[56] References Cited

U.S. PATENT DOCUMENTS

| | | | |
|---|---|---|---|
| 2,841,958 | 7/1958 | Stokes et al. | 60/39.65 |
| 3,362,160 | 1/1968 | Bourgeois | 415/118 |
| 3,504,490 | 4/1970 | Klamm | 60/39.09 |
| 3,917,432 | 11/1975 | Feuerstein et al. | 415/118 |
| 3,936,217 | 2/1976 | Travaglini et al. | 415/118 |
| 4,232,513 | 11/1980 | Pearson et al. | 60/39.09 R |
| 4,300,774 | 11/1981 | Hollis et al. | 60/39.75 |
| 4,377,933 | 3/1983 | Lojou | 60/39.08 |
| 4,406,580 | 9/1983 | Baran, Jr. | 415/118 |

*Primary Examiner*—Donald E. Stout

*Attorney, Agent, or Firm*—Jules J. Morris; Donald J. Singer

[57] ABSTRACT

The invention comprises a borescope plug for sealing a borescope inspection port on a turbine engine having a fluid flowpath and multiple casings. The borescope plug comprises a plug body having an interlocking drive interface, a plunger portion positioned for sliding coaxial movement relative to the plug body and spring means engaging both the plug body and the plunger. The spring means presses the plunger towards a fully extended position relative to the plug body. The plunger comprises a fixedly attached tip portion shaped to conform with the fluid flowpath. Key means is provided for aligning the tip to conform with the fluid flowpath and the tip is cooled with a cooling airflow.

19 Claims, 3 Drawing Sheets

BORESCOPE PLUG

STATEMENT OF GOVERNMENT INTEREST

The invention described herein may be manufactured and used by or for the Government for governmental purposes without the payment of any royalty thereon.

TECHNICAL FIELD

This invention relates to aircraft gas turbine engines and particularly to fittings used to close borescope inspection ports on gas turbine engines.

BACKGROUND

Borescope inspection ports are currently in common use on most gas turbine engines. Borescope ports allow visual inspection of internal aircraft engine flowpath hardware with a fiber optic borescope. These borescope ports thereby make possible frequent critical engine inspections that otherwise could not be performed without disassembly of the aircraft engine. This allows increased engine usage between overhaul and thus lowers aircraft engine operating costs.

During engine operation borescope plugs are used to close the inspection ports on the engine and prevent the escape of high pressure engine gases. Conventional borescope plugs typically resemble the prior art borescope plug 10 shown in FIG. 1. The plug 10 closes a port 12 through an inner casing 14 and seals the flowpath structure 16 at port 18. A spring loaded plunger 20 seals against the port 18. A conventional bolt head 22 is provided for assembling and disassembling the plug from the threaded mount 24. The engines outer flowpath 26 is sealed with a cover plate 28.

There are several deficiencies with conventional borescope plugs having designs similar to that shown in FIG. 1. A major problem is that these plugs are difficult to assemble to and disassemble from the engine's inner case. Disassembly requires removal of the cover plate 28 and the snaking of a tool through the hole in the outer casing 26 and onto the borescope plug at bolt head 22. When the borescope plug is unscrewed from the mount 24, it is slowly removed with the tool. If the plug falls off the tool it can fall freely in the space between the inner and outer ducts. This would require duct removal for plug recovery. Assembly of the conventional plug to the engine comprises the reverse of the above steps. Thus assembly and disassembly of this conventional style plug takes a certain degree of skill and luck to avoid accidental misplacement of the plug.

Another deficiency with conventional borescope plugs is the uncertainty of whether or not the borescope plug is in place during engine inspection. If cover plate 28 is inadvertently resecured over removal hole 30 while the borescope plug is out of position visual inspection will not ascertain the problem. Open borescope holes through the flowpath and inner duct will result in poor engine operation.

A further undesireable characteristic of the conventional borescope plug is that the plug tip 32 does not conform to the flowpath surface. This can result in airflow problems and, in certain areas of the engine, in overheating of the tip 32 due to stagnating heated air. This is particularly a problem in areas with an angled or conical flowpath.

A need therefore exists for an improved borescope plug that is easy to assemble and disassemble from a turbine engine.

A further need exists for a borescope plug that is easy to visually inspect prior to engine operation.

A need also exists for an improved borescope plug that has minimal impact on engine airflow and is suitable for use in high temperature flowpath areas.

SUMMARY OF THE INVENTION

The invention comprises a borescope plug for sealing a borescope inspection port on a turbine engine having a fluid flowpath and multiple casings. The borescope plug preferrably comprises a plug body having an interlocking drive interface, a plunger portion positioned for sliding coaxial movement relative to the plug body and spring means engaging both the plug body and the plunger in a manner which forces the plunger towards a fully extended position.

In the preferred embodiment of the invention the borescope plug further comprises a tip portion fixedly attached to the plunger portion and shaped to conform with a fluid flowpath. Key means is therefore provided for aligning the borescope plug with the fluid flowpath surface so that the tipped portion will be correctly aligned.

Another aspect of the preferred embodiment of the invention includes cooling holes in the plunger portion of the borescope plug for directing a cooling airflow to the tip portion in order to prevent overheating of the borescope tip. Seal means are provided for restricting airflow around the borescope plug and preventing excessive cooling air outflow. The seal means preferrably comprises a tube seal substantially surrounding the plunger portion of the borescope plug, a ring seal which sealing engages the plug body and a sealing flange positioned on the plunger portion of the borescope plug for engagement with a flowpath mating shoulder.

In the preferred embodiment of the invention, the borescope plug also comprises interlocking tool retention means at the drive interface which prevents inadvertent separation of the drive tool and the borescope plug.

It is therefore an object of the invention to provide an improved borescope plug which is both easy to assemble and disassemble.

It is a further object of this invention to provide a borescope plug that has minimal impact upon engine airflow.

It is yet another object of this invention to provide a borescope plug suitable for use in high temperature flowpath areas.

BRIEF DESCRIPTION OF THE DRAWINGS

The foregoing and other objects and advantages of the invention will be apparent from the following more particular description of the preferred embodiments of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE INVENTION

Figure 1:
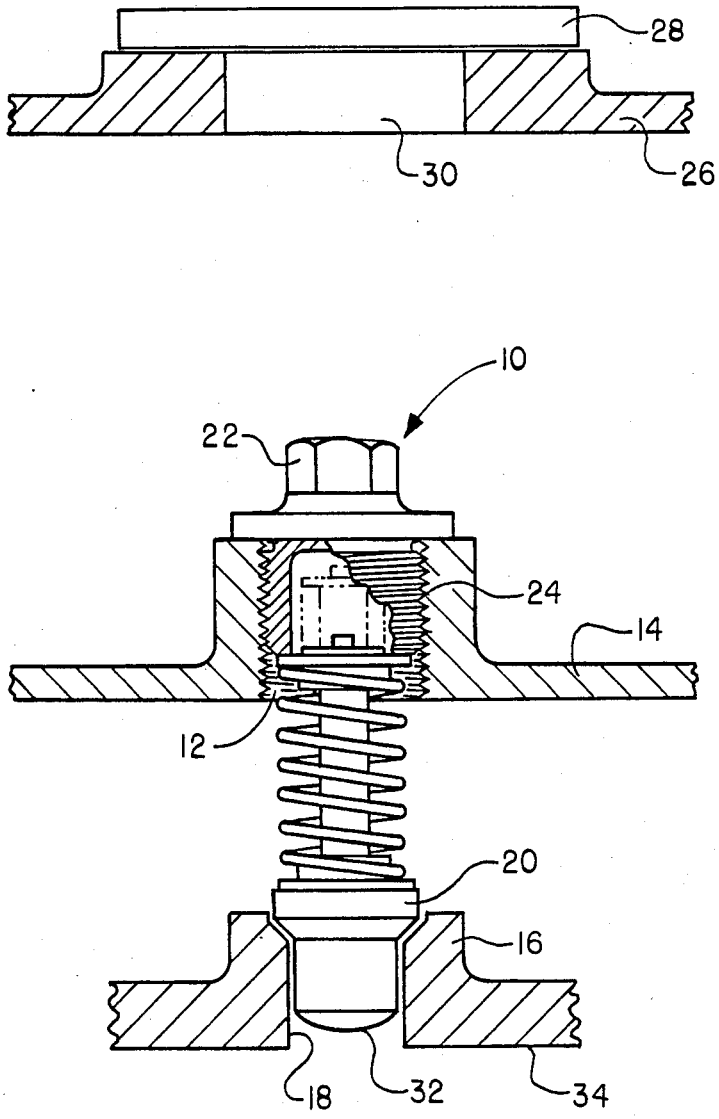
FIG. 1 PRIOR ART
FIG. 1 is a cross sectional representation of a conventional borescope plug installed in a borescope inspection port of a turbine engine, it comprises prior art.
Figure 2:
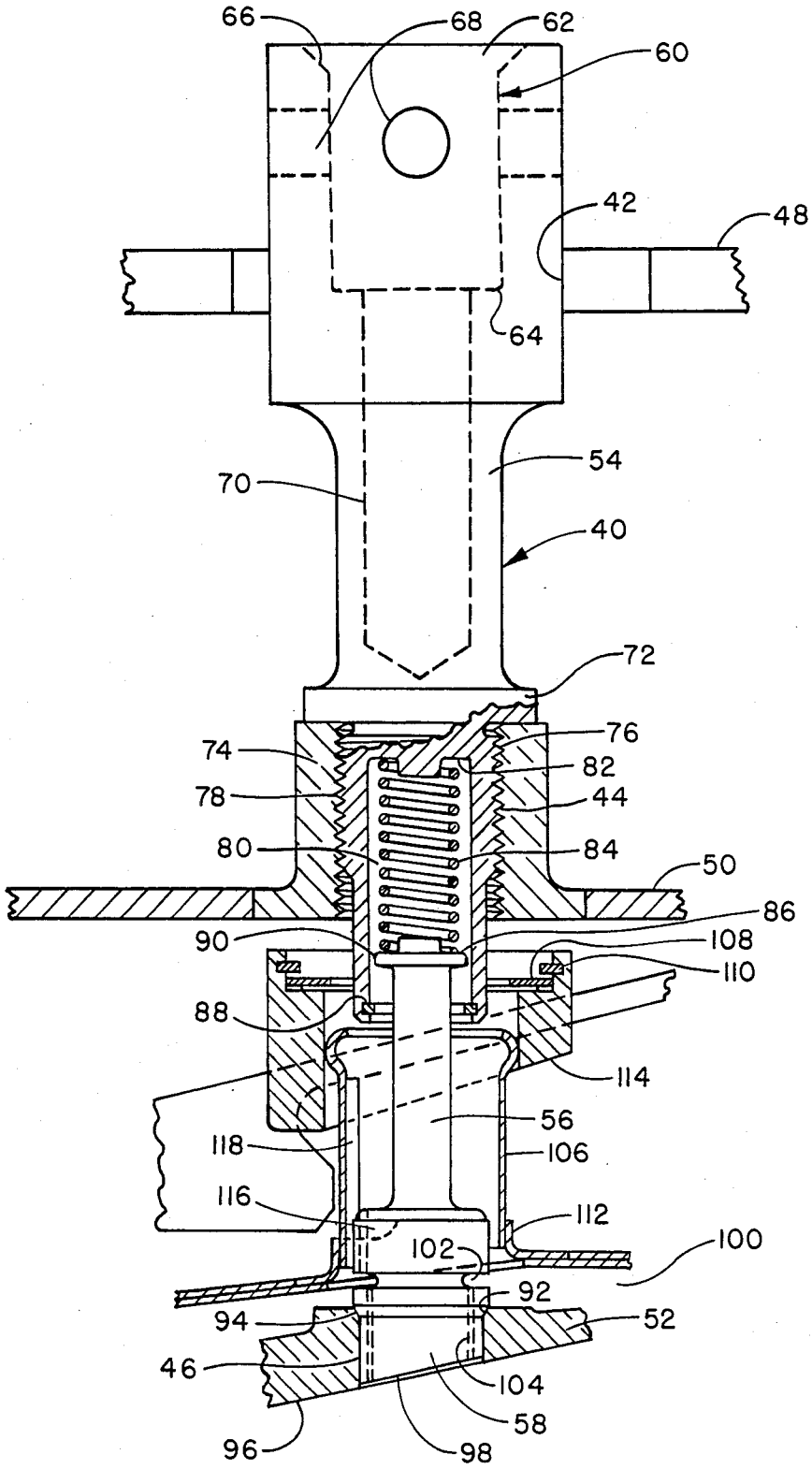
FIG. 2 is a side view with interior detail shown in dotted lines of a borescope plug embodying the principles of this invention, the plug is shown installed in a borescope inspection port.

FIG. 2 shows a borescope plug 40, incorporating the principles of this invention, installed in a borescope inspection port which comprises an outer casing port 42, a borescope plug mount 44 and a flowpath port 46. The borescope plug therefore extends from outside the engine through an outer casing 48 and an inner casing 50 so that it may fill the flowpath port 46 in the flowpath structure 52.

The borescope plug 40 comprises a plug body 54, a plunger portion 56 and a tip portion 58. The plunger portion is positioned for sliding coaxial movement relative to the plug body and the tip portion 58 is firmly attached to the plunger portion 56.

The plug body 54 extends from outside the outer casing 48 through the inner casings 50. A hole 70 in the center of plug body 54 minimizes plug weight while maintaining adequate tortional stiffness. A drive interface 60 is also provided in the form of a square drive hole 62 which is coaxial with cavity 70 and the long axis of the cylindrical plug body. The drive interface 60 is designed for interlocking attachment of a common square drive socket wrench and has a guide flange 66 and four locking holes 68. The locking feature interacts with a conventional spring ball in a square drive socket wrench to make a positive attachment between the borescope plug 40 and the square drive wrench. This insures that the borescope plug is only be removed from interlocking wrench with depression of a conventional socket release mechanism The borescope plug body 54 also comprises a seating shoulder 72 which seats to a borescope plug mount 74 on the inner casing 50. A lower portion of the borescope plug body is provided with threads 76 that engage threads 78 on the plug mount 74. Shoulder 72 sits on plug mount 74 when the borescope plug is firmly threaded down.

The lower portion of the plug body comprises an axial cavity 80 having circular spring seat 82. A cylindrical spring 84 extends from the spring seat 82 to the plunger portion 56 which has a complimentary spring seat 86. The spring 84 tends to force the plunger 56 as far down in the axial cavity 80 as possible. The plunger is equipped with a flange 90 that engages retainer 88 to prevent exit of the plunger 56 from the axial cavity 80 of the plug body 54. The plunger portion will bottom against retainer 88 when disassembled from the borescope inspection port.

Plunger 56 extends from the plug body cavity 80 to include the tip portion 58 that seats in the flowpath structure 52 of the turbine engine. A spherical chamfer 92 seals against a flowpath chamfer 94 in order to properly position the tip 58 relative to the flowpath fluid surface 96. Tip surface 98 will either be at or slightly recessed from the flowpath surface 96 when the tip chamfer is seated.

The borescope plug 40 also comprises cooling means for cooling the borescope plug tip and seal means to prevent escape of cooling air. Cooling airflow is directed from internal flowpath cavity 100 into recess 102 of the borescope tip. Holes 104 through the tip direct the air to surface 98 which is exposed to the engine airflow. Excess cooling airflow about the tip is prevented by the spherical chamfer 92 on the plunger portion which seals with reciprocal flange 94 of the flowpath structure 52. A tube seal 106 in combination with sliding seal 108 prevents escape of cooling airflow by trapping the air from cavity 100 adjacent to the plunger portion 56. Sliding seal 108 is retained adjacent to plug body 54 by annular retainer 110 whereas tube seal 106 has a slight interference fit with a portion of the flowpath structure 112 and is flared for a sealing fit to the support structure 114. Uncontrolled flow of pressurized air is therefore prevented by the sliding seal 108, the tube seal 106 and the exit chamfer 92 which seats against the flowpath structure 52.

An advantage of the borescope plug of FIG. 2 is its ability to be installed with the plug tip conforming to a conical or angled flowpath. Surface 98 is angled and properly oriented relative to surface 96 for a conforming flowpath surface. This orientation is provided by a keyway 116 in the plunger portion and a key 118 provided at or through the tube seal 106. By using this key feature the plug is always aligned with the correct orientation when the borescope plug is screwed into place. When the borescope plug is threaded into the inspection port the plunger portion 56 rotates with the borescope plug body until the keyway 116 engages the key 118. The plunger portion is then snapped down by spring 84 in the correct orientation relative to the flowpath 96. Without such a key feature the angled plug tip could protrude into the engine flowpath and cause airflow and thermal problems.

Borescope plug 40 of this invention has several advantages over the conventional borescope plugs. Since borescope plug 40 extends through both the outer and the inner engine casings 48, 50 it removes the visual uncertainty of whether or not a borescope plug has been properly installed. No borescope cover plates need to be removed to check the seating of the borescope plug.

Further, the borescope plug is provided with holes and grooves to maintain proper tip cooling and allow use of the borescope plug in higher temperature airflow environments than would otherwise be possible.

This borescope plug can be positioned in close proximity to adjacent flanges and structures since no large cover plate and mounting arrangement is required.

Figure 3:
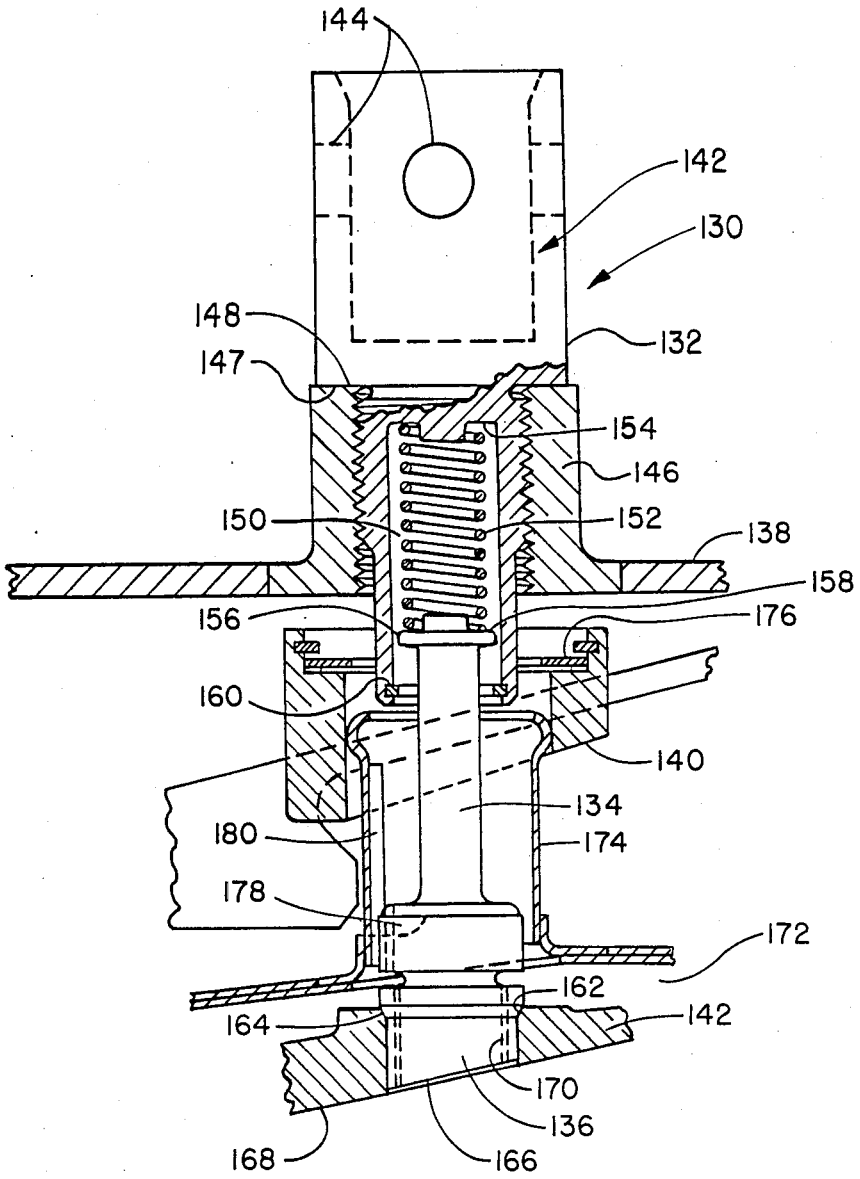
FIG. 3 is a side view of an alternative embodiment of a borescope plug embodying the principle of this invention.

In some instances it may be desireable to use a borescope plug incorporating some of the features of the borescope plug of FIG. 2 but only extending through a single casing. An embodiment of a borescope plug for penetrating a single casing is shown in FIG. 3. The shortened borescope plug 130 is in most respects identical to borescope plug 140 of FIG. 2.

The shortened borescope plug 130 comprises a plug body 132, a plunger 134 an a plunger tip 136. The plug body 132 extends through an inner casing 138 into a support structure 140. The plunger 130 and tip 136 extend through the flowpath structure 142.

Plug body 132 is similar to plug body 154 of FIG. 2 except that the central extension with the weight reducing cavity (70) has been omitted. A drive interface 142 is, however, still provided for interlocking with a square drive wrench and incorporates locking holes 44 for positive interlock with the wrench.

The plug body threads down into a plug mount 146 in the inner case and seats against top surface 147 with the bottom surface 148 of the drive interface section 142.

An interior axial cavity 150 is provided for spring 152 which seats in annular spring mounts 154 and 156. A flange 158 is provided on the plunger 134 for interaction with retainer 160 in order to maintain plunger 134 within the axial cavity 150.

The plunger 134 is identical to plunger 56 of the previous embodiment. A sealing flange 162 is provided for engaging flange 164 on the flowpath structure 142. Tip flowpath surface 166 is angled to conform with the flowpath surface 168 of the flowpath structure 142 and cooling holes 170 are fed from a cooling cavity 172. A keyway slot 178 and key 180 are provided for orientation of angle tip surface 166 with flowpath 168.

The seal means once again comprises flange 162, tube seal 174 and floating seal 176. In all respects these sealing means are identical to that discussed in reference to the previous embodiment.

The locking feature 144 in the drive interface allows for assembly and disassembly of the borescope plug without risking accidental loss of the plug in the duct work. The cooling, sealing and flow conforming attributes of this smaller borescope plug 130 are otherwise the same and have the same advantages as those previously discussed with reference to the first embodiment.

While the invention has been discussed with reference to the preferred embodiment thereof, it will be understood by those skilled in the art that various changes in substance and form can be made therein without departing from the spirit and scope of the invention as described in the attached claims.

We claim:

1. A borescope plug for sealing a borescope inspection port on a turbine engine having a fluid flowpath and casings, the borescope plug comprising:

a plug body including a drive tool interface, a plunger portion positioned for sliding coaxial movement relative to said plug body;

a spring means engaging said plug body and said plunger which forces said plunger portion towards a fully extended position;

a tip portion fixedly attached to said plunger portion, said tip portion shaped to conform with a fluid flowpath surface of the turbine engine; and key means for aligning said tip portions with the fluid flowpath surface.

2. The borescope plug of claim 1 wherein said plunger portion further comprises cooling holes for directing a cooling airflow to said tip portion.

3. The borescope plug of claim 1 wherein said probe body further comprises a threaded portion for engagement with a threaded borescope plug hole in an engine inner casing.

4. The borescope plug of claim 1 wherein said tip portion is angled to conform with the fluid flowpath surface.

5. The borescope plug of claim 1 wherein said probe body further comprises an axial cavity for accepting sliding engagement of said plunger portion and for positioning said spring means between said plug body and said plunger portion.

6. The borescope plug of claim 5 further comprising retention means for preventing exit of said plunger portion from said axial cavity of said plug body.

7. The borescope plug of claim 6 wherein said plunger portion further comprises a retention shoulder for engagement with said retention means.

8. The borescope plug of claim 1 wherein said drive tool interface further comprises tool interlocking means.

9. The borescope plug of claim 2 wherein said plunger portion further comprises a sealing flange for preventing leakage of the cooling airflow around said tip portion.

10. A borescope port assembly for a turbine engine comprising:

a borescope port penetrating an inner and outer turbine casing; and a plug body including a drive interface, a plunger portion slideably positioned for coaxial movement relative to said plug body;

a spring means engaging said plug body and said plunger which forces said plunger portion towards a fully extended position;

a tip portion fixedly attached to said plunger portion, said tip portion shaped to conform with a fluid flowpath surface; and a key means for aligning said borescope plug tip portion with the fluid flowpath surface.

11. The borescope port assembly of claim 10 wherein said plunger portion further comprises cooling holes for directing a cooling airflow to said tip portion.

12. The borescope port assembly of claim 10 further comprising seal means for restricting airflow about said borescope plug.

13. The borescope port assembly of claim 12 wherein said seal means further comprises a tube seal substantially surrounding said plunger portion of the borescope plug.

14. The borescope port assembly of claim 12 wherein said seal means further comprises a ring seal which sealingly engages said plug body of the borescope plug.

15. The borescope port assembly of claim 12 wherein said seal means further comprises a sealing flange positioned on said plunger portion of said borescope plug for engagement with a flowpath mating shoulder adjacent to a fluid flowpath surface in order to prevent cooling air leakage.

16. The borescope port assembly of claim 10 wherein said inner casing further comprises an internally threaded mating collar.

17. The borescope port assembly of claim 16 wherein said plug body further comprises an externally threaded section and a seating shoulder for seating engagement with said internally threaded mating collar.

18. The borescope port assembly of claim 10 wherein said key means comprises a key fixedly positioned in said borescope port and a key way on said plunger portion for engagement with said key in order to align said borescope plug relative to the fluid flowpath.

19. A borescope plug for sealing a borescope inspection port on a turbine engine having a fluid flowpath and casings, the borescope plug comprising:

a plug body including a drive tool surface, a plunger portion positioned for sliding coaxial movement relative to said plug body;

a spring means engaging said plug body and said plunger which forces said plunger portion towards a fully extended position; and a tip portion fixedly attached to said plunger portion, said tip portion shaped to conform with a fluid flowpath surface of the turbine engine and wherein said plunger portion comprises cooling holes for directing a cooling airflow to said tip portion.

* * * * *